US007519508B2

(12) United States Patent
Newman

(10) Patent No.: US 7,519,508 B2
(45) Date of Patent: Apr. 14, 2009

(54) METHOD AND SYSTEM FOR SETTING AND ANALYZING TUBING TARGET PRESSURES FOR TONGS

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 240 days.

(21) Appl. No.: 11/516,153

(22) Filed: Sep. 5, 2006

(65) Prior Publication Data

US 2007/0067107 A1 Mar. 22, 2007

Related U.S. Application Data

(60) Provisional application No. 60/716,612, filed on Sep. 13, 2005.

(51) Int. Cl.
*G06F 19/00* (2006.01)
*G06F 17/40* (2006.01)

(52) U.S. Cl. ..... 702/182; 73/49.7; 73/49.8; 73/761; 340/665; 340/679; 340/870.01; 702/41; 702/42; 702/187; 702/189

(58) Field of Classification Search ..... 73/37, 73/49.7, 49.8, 760, 761; 340/500, 540, 665, 340/679, 680, 870.01, 870.16; 702/1, 33, 702/34, 41, 42, 85, 98, 104, 108, 113, 114, 702/127, 138, 182, 187, 189
See application file for complete search history.

(56) References Cited

U.S. PATENT DOCUMENTS 2,883,255 A * 4/1959 Anderson ..... 346/34
3,244,404 A 4/1966 Coyle, Sr. ..... 81/470
3,257,652 A * 6/1966 Foster ..... 340/521
3,348,234 A * 10/1967 Foster ..... 347/231
3,745,820 A 7/1973 Weiner ..... 73/139
4,519,040 A * 5/1985 Brankamp et al. ..... 700/177
4,552,041 A * 11/1985 Coyle, Sr. ..... 81/470
4,581,711 A * 4/1986 Hirata et al. ..... 702/64
4,633,720 A * 1/1987 Dybel et al. ..... 73/862.53
4,831,364 A * 5/1989 Shinohara et al. ..... 340/680
5,131,130 A * 7/1992 Eshghy ..... 29/407.02
5,212,862 A * 5/1993 Eshghy ..... 29/407.03
5,233,742 A 8/1993 Gray et al. ..... 29/407.03

(Continued)

OTHER PUBLICATIONS

PCT/US06/34994 International Search Report and the Written Opinion of the International Searching Authority, or the Declaration—Date of mailing Aug. 7, 2007.

*Primary Examiner*—Edward R Cosimano
(74) *Attorney, Agent, or Firm*—King & Spalding LLP

(57) ABSTRACT

A target pressure value is determined during the learning mode. Subsequent pressure values are then compared to the target value. For example, a first connection is tightened in a conventional manner, while its pressure is monitored during the learning mode. If the tightening process went well, then an operator pushes a button that tells the monitor to remember how much pressure was used on the tongs to tighten the first connection. The pressure value of that first joint then becomes the target pressure value for any subsequent joints. As additional joints are tightened, the pressure applied to the tongs is monitored and compared to the first one to ensure that all the joints are as good as the first one within an allowable tolerance.

34 Claims, 12 Drawing Sheets

U.S. PATENT DOCUMENTS 5,284,217 A * 2/1994 Eshghy ..... 173/176
5,449,877 A * 9/1995 Buda et al. ..... 219/110
5,711,382 A 1/1998 Hansen et al.
5,988,299 A 11/1999 Hansen et al.
6,079,490 A 6/2000 Newman
6,212,763 B1 4/2001 Newman ..... 29/702
6,276,449 B1 8/2001 Newman
6,728,638 B2 4/2004 Newman
7,359,801 B2 * 4/2008 Newman ..... 702/9
2004/0226712 A1 11/2004 Hood et al.
2007/0056727 A1 * 3/2007 Newman ..... 166/250.01
2007/0056746 A1 * 3/2007 Newman ..... 166/383
2007/0089878 A1 * 4/2007 Newman ..... 166/255.1
2007/0288169 A1 * 12/2007 Newman ..... 702/6

* cited by examiner

METHOD AND SYSTEM FOR SETTING AND ANALYZING TUBING TARGET PRESSURES FOR TONGS

STATEMENT OF RELATED PATENT APPLICATION

This non-provisional patent application claims priority under 35 U.S.C. §119 to U.S. Provisional Patent Application No. 60/716,612, titled Interpretive Techniques Using Sensor Data, filed Sep. 13, 2005. This provisional application is hereby fully incorporated herein by reference.

FIELD OF THE INVENTION

The current invention generally relates to assembling threaded sucker rods and tubulars of oil wells and other wells. More specifically, the invention pertains to a device that monitors and displays the pressures applied by a set of tongs to the rods and tubulars of the wells.

BACKGROUND OF THE INVENTION

Oil wells and many other types of wells often comprise a well bore lined with a steel casing. A casing is a string of pipes that are threaded at each end to be interconnected by a series of internally threaded pipe couplings. A lower end of the casing is perforated to allow oil, water, gas, or other targeted fluid to enter the interior of the casing.

Disposed within the casing is another string of pipes interconnected by a series of threaded pipe couplings. This internal string of pipes, known as tubing, has of a much smaller diameter than casing. Fluid in the ground passes through the perforations of the casing to enter an annulus between the inner wall of the casing and the outer wall of the tubing. From there, the fluid forces itself through openings in the tubing and then up through the tubing to ground level, provided the fluid is under sufficient pressure.

If the natural fluid pressure is insufficient, a reciprocating piston pump is installed at the bottom of the tubing to force the fluid up the tubing. A reciprocating drive at ground level is coupled to operate the pump's piston by way of a long string of sucker rods that is driven up and down within the interior of the tubing. A string of sucker rods are typically comprised of individual solid rods that are threaded at each end so they can be interconnected by threaded couplings.

Since casings, tubing and sucker rods often extend thousands of feet, so as to extend the full depth of the well, it is imperative that their respective coupling connections be properly tightened to avoid costly repair and downtime. Couplings for tubulars (i.e., couplings for tubing and casings), and couplings for sucker rods are usually tightened using a tool known as tongs. Tongs vary in design to suit particular purposes, i.e., tightening tubulars or rods, however, each variety of tongs shares a common purpose of torquing one threaded element relative to another. Tongs typically include a hydraulic motor that delivers a torque to a set of jaws that grip the element or elements being tightened.

Various control methods have been developed in an attempt to ensure that sucker rods and tubulars are properly tightened. However, properly tightened joints can be difficult to consistently achieve due to numerous rather uncontrollable factors and widely varying specifications of tubulars and sucker rods. For instance, tubing, casings and sucker rods each serve a different purpose, and so they are each designed with different features having different tightening requirements.

But even within the same family of parts, numerous variations need to be taken into account. With sucker rods, for example, some have tapered threads, and some have straight threads. Some are made of fiberglass, and some are made of stainless steel. Some are a half-inch in diameter, and some are over an inch in diameter. With tubing, some have shoulders, and some do not.

And even for a given part, other conditions may vary. For instance, when tightening the first few sucker rods at the beginning of a day, the hydraulic fluid driving the tongs may be relatively cool and viscous. Later in the day, the hydraulic fluid may warm up, which may cause the tongs to run faster. The hydraulic fluid changing temperature or changing from one set of tongs to another may result in inconsistent tightening of the joints. Even supposedly identical tongs of the same make and model may have different operating characteristics, due to the tongs having varying degrees of wear on their bearings, gears, or seals. Also, the threads of some sucker rods may be more lubricated than others. Some threads may be new, and others may be worn. These are just a few of the many factors that need to be considered when tightening sucker rods and tubulars.

It can be very difficult to provide a control method for tongs that takes into consideration all the various factors that affect the process of tightening tubulars and sucker rods. Since many factors cannot be readily quantified by those who specify the torque to which a particular part should be tightened, specifying a particular torque is risky.

Consequently, a need exists for a display system that adapts to various conditions at a well site where sucker rods, casings, or tubing are being tightened.

SUMMARY OF THE INVENTION

To provide a control and display system that adapts to various conditions at a well site where sucker rods, casing, or tubing is being tightened, it is an object of the invention to provide such a system with a learning mode wherein the system develops a target pressure value based on tightening a particular connection.

Another object of some embodiments of the invention is to provide a display system that allows an operator to determine if a joint connection was made at the proper pressure.

Another object of the present invention is to provide a visual display of the maximum pressure that was applied to each joint and using representations on the display screen to determine the speed that the operator is completing the connection process.

Yet another object of the present invention is to provide a display system that can be used when tightening sucker rods, casing, and tubing.

A further object of the present invention is to provide a monitor or control system that does not need to know the size, grade, or other design specifications of the tubular or sucker rod being tightened.

Another object of the present invention is to provide a monitor system that does not need to know what type of tongs is being monitored.

These and other objects of the invention are provided by a display for data relating to tongs that includes a learning mode and a monitoring mode. Pressure readings taken during the monitoring mode are compared to a target pressure value established during the learning mode.

DETAILED DESCRIPTION OF THE EXEMPLARY EMBODIMENTS

Figure 1:
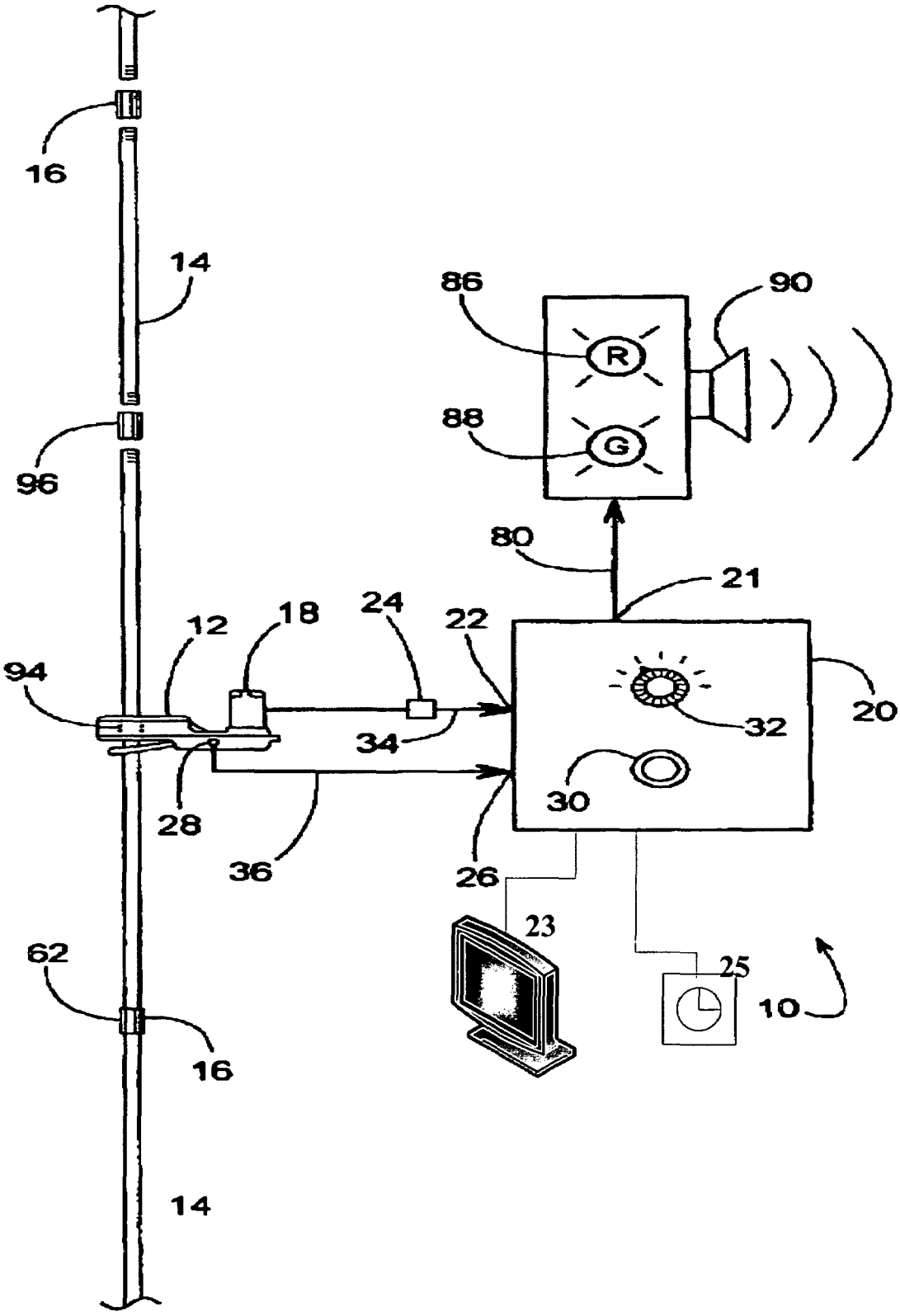
FIG. 1 is a schematic diagram of a system that monitors a set of tongs tightening a string of elongated members according to one exemplary embodiment of the present invention.

A monitor 10 for monitoring the tightening operation of a set of tongs 12 is shown in FIG. 1. Monitor 10 includes a learning mode that enables the monitor to adapt to various tongs and operating conditions. After temporarily operating in the learning mode, monitor 10 shifts to a monitoring mode. Readings taken during the monitoring mode are compared to those taken during the learning mode to determine whether any changes occurred during the tightening operation.

Tongs 12 are schematically illustrated to represent various types of tongs including, but not limited to, those used for tightening sucker rods, tubing or casings. In FIG. 1, tongs 12 are shown used in assembling a string of elongated members 14, which are schematically illustrated to represent any elongated member with threaded ends for interconnecting members 14 with a series of threaded couplings 16. Examples of elongated members 14 include, but are not limited to sucker rods, tubing, and casings. Tongs 12 include at least one set of jaws for gripping and rotating one elongated member 14 relative to another, thereby screwing at least one elongated member into an adjacent coupling 16. A drive unit 18 drives the rotation of the jaws. Drive unit 18 is schematically illustrated to represent various types of drive units including those that can move linearly (e.g., piston/cylinder) or rotationally and can be powered hydraulically, pneumatically or electrically.

In a currently preferred embodiment, monitor 10 comprises an electrical circuit 20 that is electrically coupled to an output 21 and four inputs. Electrical circuit 20 is schematically illustrated to represent any circuit adapted to receive a signal through an input and respond through an output. Examples of circuit 20 include, but are not limited to, computers, programmable logic controllers, circuits comprising discrete electrical components, circuits comprising integrated circuits, and various combinations thereof.

The inputs of circuit 20, according to some embodiments of the invention, include a first input 22 electrically coupled to a first sensor 24, a second input 26 electrically coupled to a second sensor 28, a learn input 30, and a tolerance input 32. However, it should be noted that monitors with fewer inputs or with inputs other than those used in this example are well within the scope of the invention.

In response to the rotational action or tightening action of tongs 12, sensors 24 and 28 provide input signals 34 and 36 respectively. The term, "rotational action" refers to any rotational movement of any element associated with a set of tongs. Examples of such an element include, but are not limited to, gears, jaws, sucker rods, couplings, and tubulars. The term, "tightening action" refers to an effort applied in tightening a threaded connection. Sensors 24 and 28 are schematically illustrated to represent a wide variety of sensors that respond to the rotational or tightening action of tongs 12. Examples of sensors 24 and 28 include, but are not limited to a pressure sensor (e.g., for sensing hydraulic pressure of a hydraulic motor); strain gage (e.g., for sensing strain as the tongs exert torque) limit switch (e.g., used as a counter for counting passing gear teeth or used in detecting a kickback action of the tongs as it begins tightening a joint); hall effect sensor, proximity switch, or photoelectric eye (e.g., used as a counter for counting passing gear teeth); and a current sensor (e.g., for measuring the power or electrical current delivered to an electric motor that in cases where an electric motor serves as the tongs' drive unit).

Learn input 30 and tolerance input 32 are user interface elements that allow a user to affect the operation of monitor 10 in ways that will be explained later. The monitor 10 may also include a display 23 communicable attached to the circuit 20 sensors 24, 28 and the inputs 30 and 32. In one exemplary embodiment, the display 23 is a monitor that provides graphic feedback to the operator; however, those of ordinary skill in the art will recognize that the display 23 may include, but not be limited to, a touchscreen display, plotter, printer, or other device for generating graphical representations. The monitor 10 also includes a timer 25 communicably connected to the circuit 20. In one exemplary embodiment, the timer 25 can be any device that can be employed with a computer, programmable logic controller or other control device to determine the elapsed time from receiving an input.

Figure 1A:
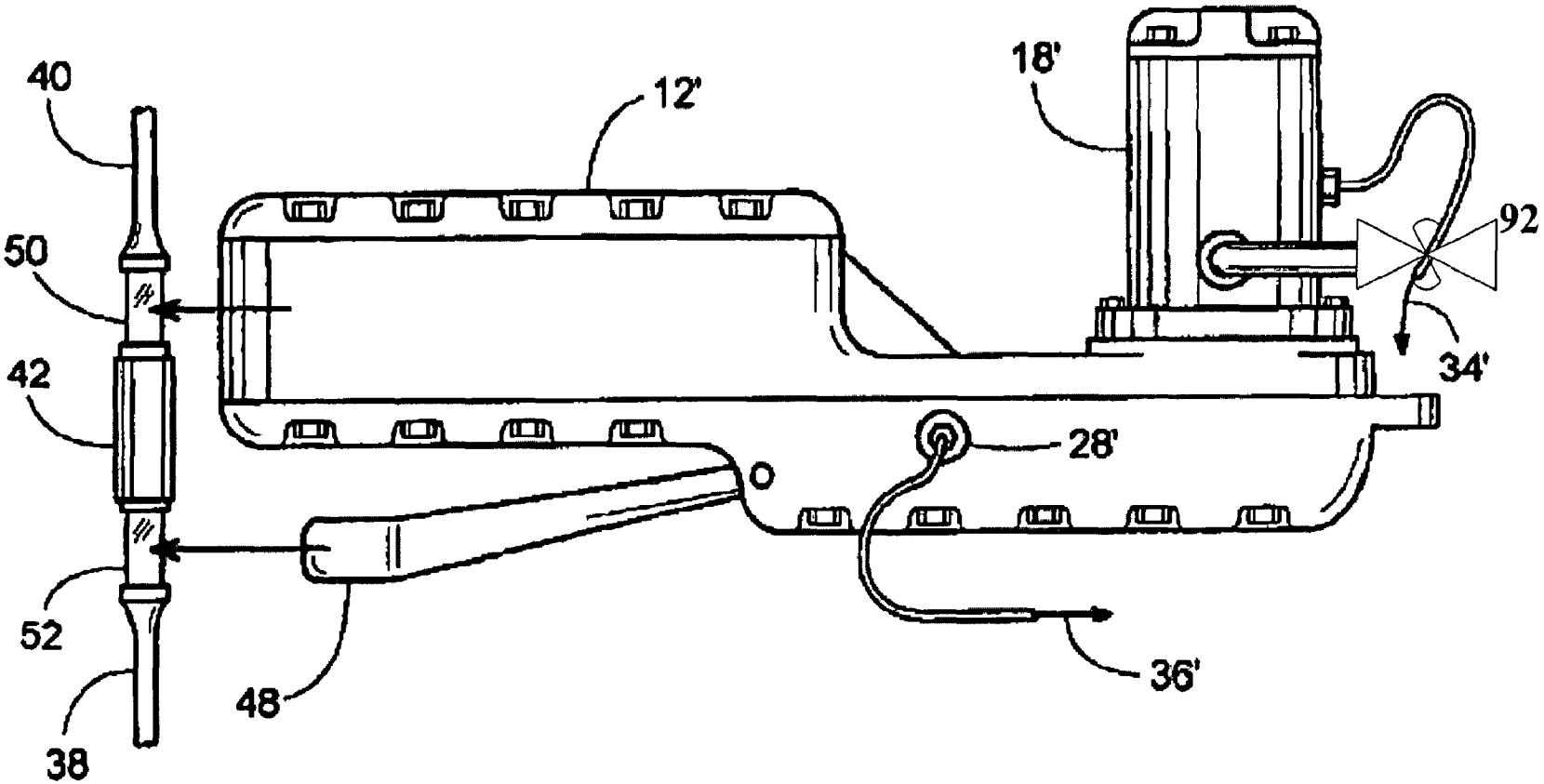
FIG. 1A is a side view of a set of tongs about to tighten two sucker rods into a coupling according to one exemplary embodiment of the present invention.
Figure 1B:
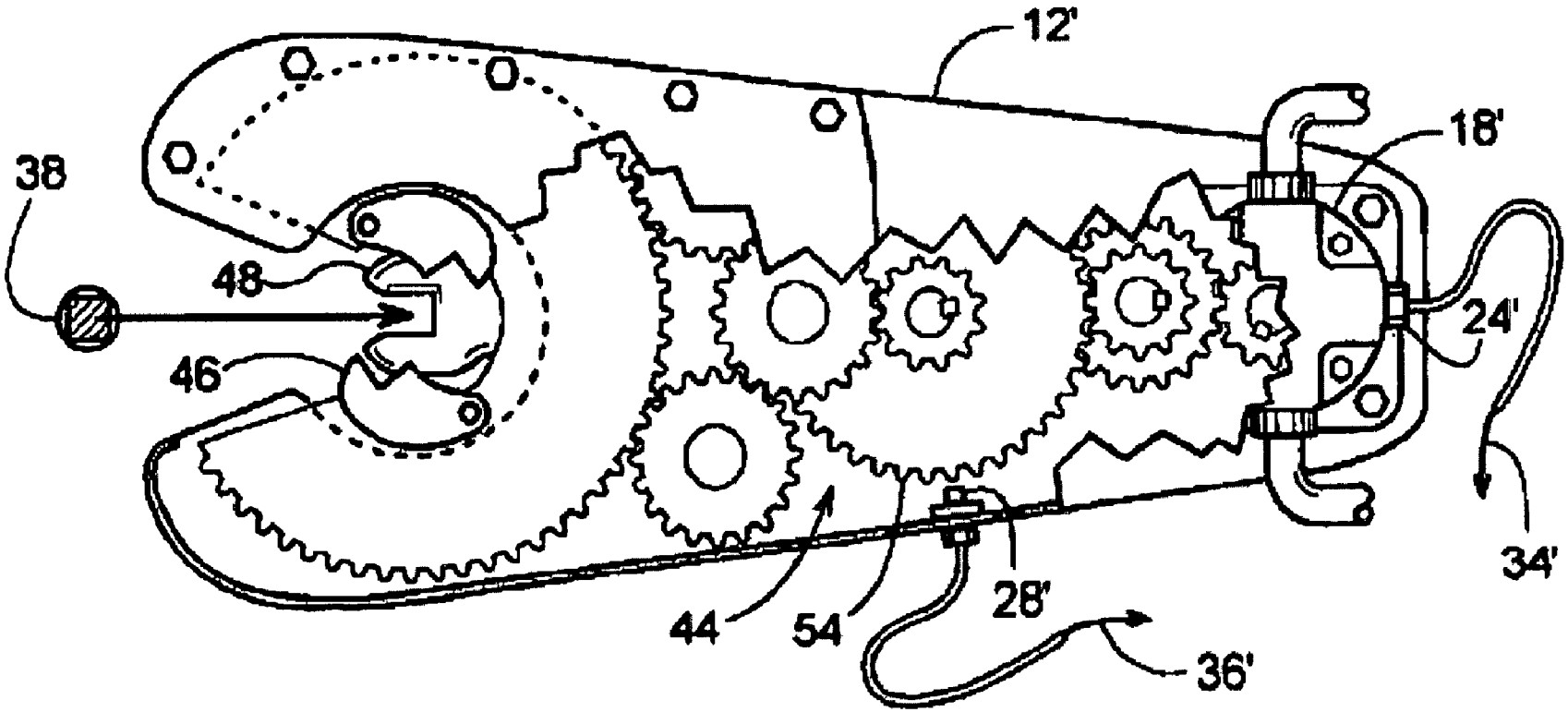
FIG. 1B is a cut-away top view of the tongs according to the exemplary embodiment of FIG. 1A.

For illustration, monitor 10 will be described with reference to a set of sucker rod tongs 12' used for screwing two sucker rods 38 and 40 into a coupling 42, as shown in FIGS. 1A and 1B. However, it should emphasized that monitor 10 can be readily used with other types of tongs for tightening other types of elongated members. In this example, a hydraulic motor 18' is the drive unit of tongs 12'. Motor 18' drives the rotation of various gears of a drive train 44, which rotates an upper set of jaws 46 relative to a lower set of jaws 48. Upper jaws 46 are adapted to engage flats 50 on sucker rod 40, and jaws 48 engage the flats 52 on rod 38. So, as jaws 46 rotate relative to jaws 48, upper sucker rod 40 rotates relative to rod 38, which forces both rods 38 and 40 to tightly screw into coupling 42.

In the example of FIGS. 1A and 1B, sensor 24' is a conventional pressure sensor in fluid communication with motor 18' to sense the hydraulic pressure that drives motor 18'. The hydraulic pressure increases with the amount of torque exerted by tongs 12', so sensor 24' provides an input signal 34' that reflects that torque. The motor 18' may also include a pressure relief valve 92. The pressure relief valve 92 limits the pressure that can be applied across the motor 18', thus helping to limit the extent to which a connection can be tightened. In one exemplary embodiment, the pressure relief valve 92 is adjustable by known adjustment means to be able to vary the amount of hydraulic pressure based on rods and tubes of varying diameters and grades.

Processes of exemplary embodiments of the present invention will now be discussed with reference to FIGS. 2-7. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 2:
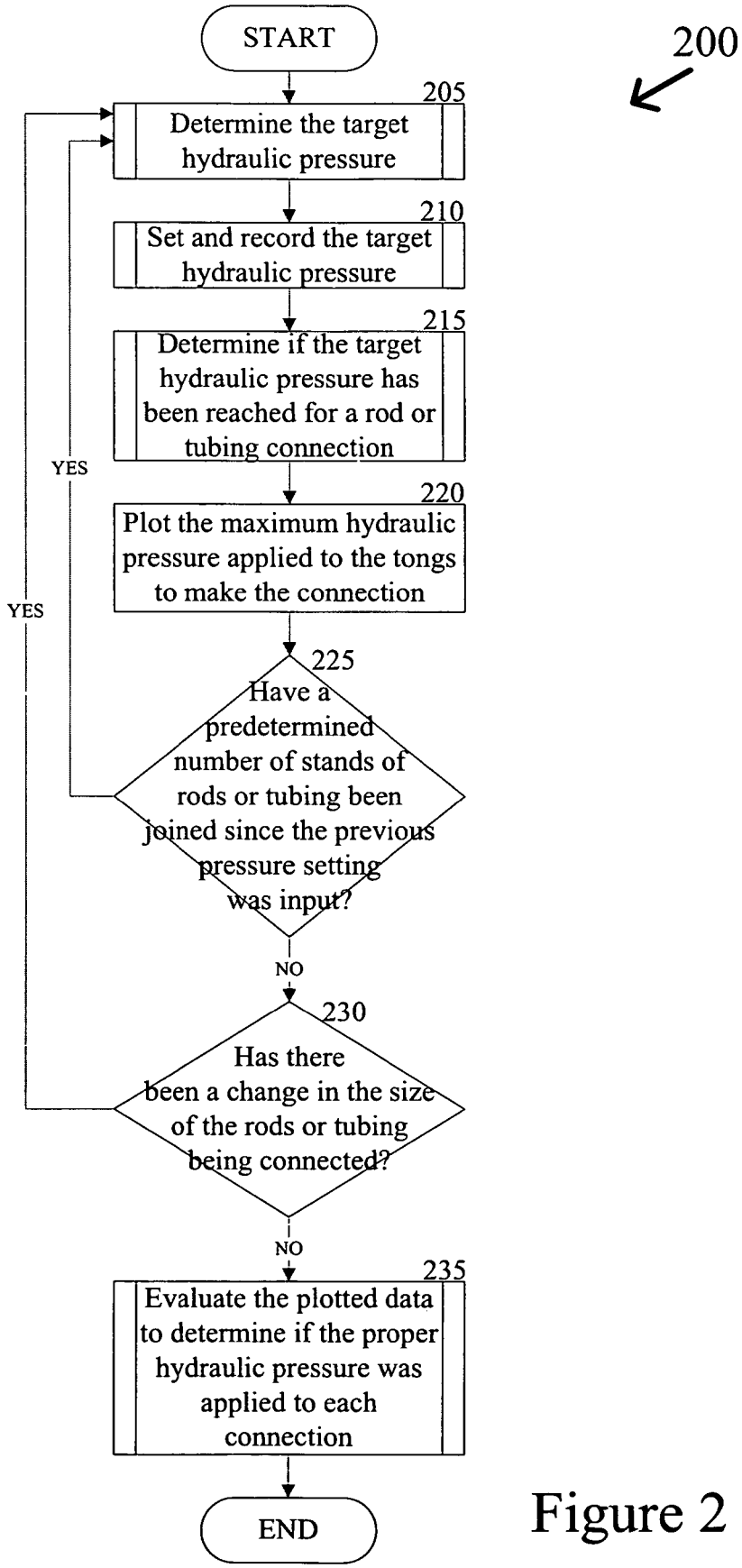
FIG. 2 is a flowchart listing the general steps of an exemplary process for setting and evaluating the target hydraulic pressure for a set of tongs connecting a rod to a stand of rods in accordance with one exemplary embodiment of the present invention.

Turning now to FIG. 2, an exemplary process 200 for setting and evaluating the target hydraulic pressure for a set of tongs 12 connecting a rod 40 to coupling 42 is shown and described within the exemplary operating environment of FIGS. 1, 1A, and 1B. Now referring to FIGS. 1, 1A, 1B, and 2, the exemplary method 200 begins at the START step and proceeds to step 205, where the target hydraulic pressure for a tightening operation completed by a set of tongs 12 on rods 38, 40 is determined. In step 210, the target hydraulic pressure for a tightening operation by a set of tongs 12 is set at the learn input 30 and displayed. In one exemplary embodiment, the target pressure is set by activating the learn input 30 at the monitor 10, and the target pressure is displayed on the display screen 23.

The current hydraulic pressure for a tightening operation by the tongs 12 on the rod 40 is evaluated and a determination is made whether the current pressure satisfies the target pressure from the input signal 34' at the sensor 24' in step 215. In step 220, the hydraulic pressure level reading from the input signal 34' at the sensor 24 is recorded and plotted on the display 23. In one exemplary embodiment, the hydraulic pressure level is recorded when it satisfies the target pressure and an output signal 80 is generated at the monitor 10. In one exemplary embodiment, the output signal 80 may include a first light 86 when the target pressure has not been reached and a second light 88 when the target pressure has been reached. In an alternative or complementary embodiment, the output signal 80 may include a horn 90 that activates within a predetermined amount of time after the target pressure has been reached.

In step 225, an inquiry is conducted to determine if a predetermined number of strings 14 of rods 40 have been joined since the most recent setting of the target pressure. In one exemplary embodiment, the target pressure should be reevaluated and reset after every ten stands of rods 40. In one exemplary embodiment, the determination is made by the operator of the tongs 12. If the predetermined number of strings 14 have been joined, then the "YES" branch is followed to step 205 where the target pressure is reset. Otherwise, the "NO" branch is followed to step 230. In step 230, an inquiry is conducted to determine if there is a taper, or a change in the size of the rods 40, being joined to the string 14. In one exemplary embodiment, different rod or tubing sizes have different API standards that must be satisfied and thus the tongs 12 will in all likelihood require a different pressure to satisfy those standards.

If there is a taper, the "YES" branch is followed to step 205, where the target pressure setting is reset. On the other hand, if there is no taper, the "NO" branch is followed to step 235, where an evaluation of the plotted data on the display 23 is conducted to determine if the string 14 of rods 40 were properly joined to the couplings 42. The process then continues from step 235 to the END step.

Figure 7:
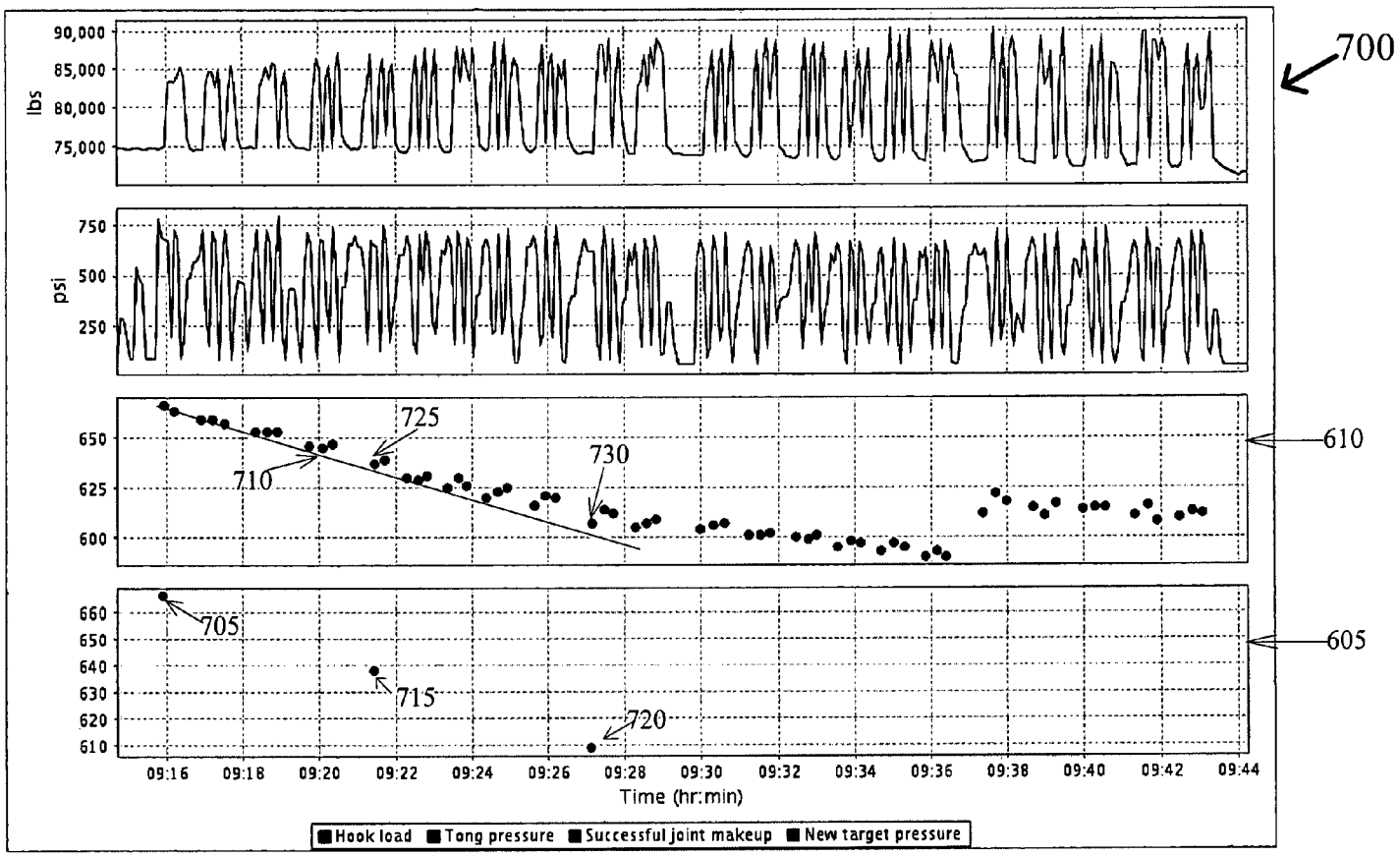
FIG. 7 is another exemplary chart displaying target hydraulic pressures and actual connection pressures in a display environment according to one exemplary embodiment of the present invention.
Figure 8:
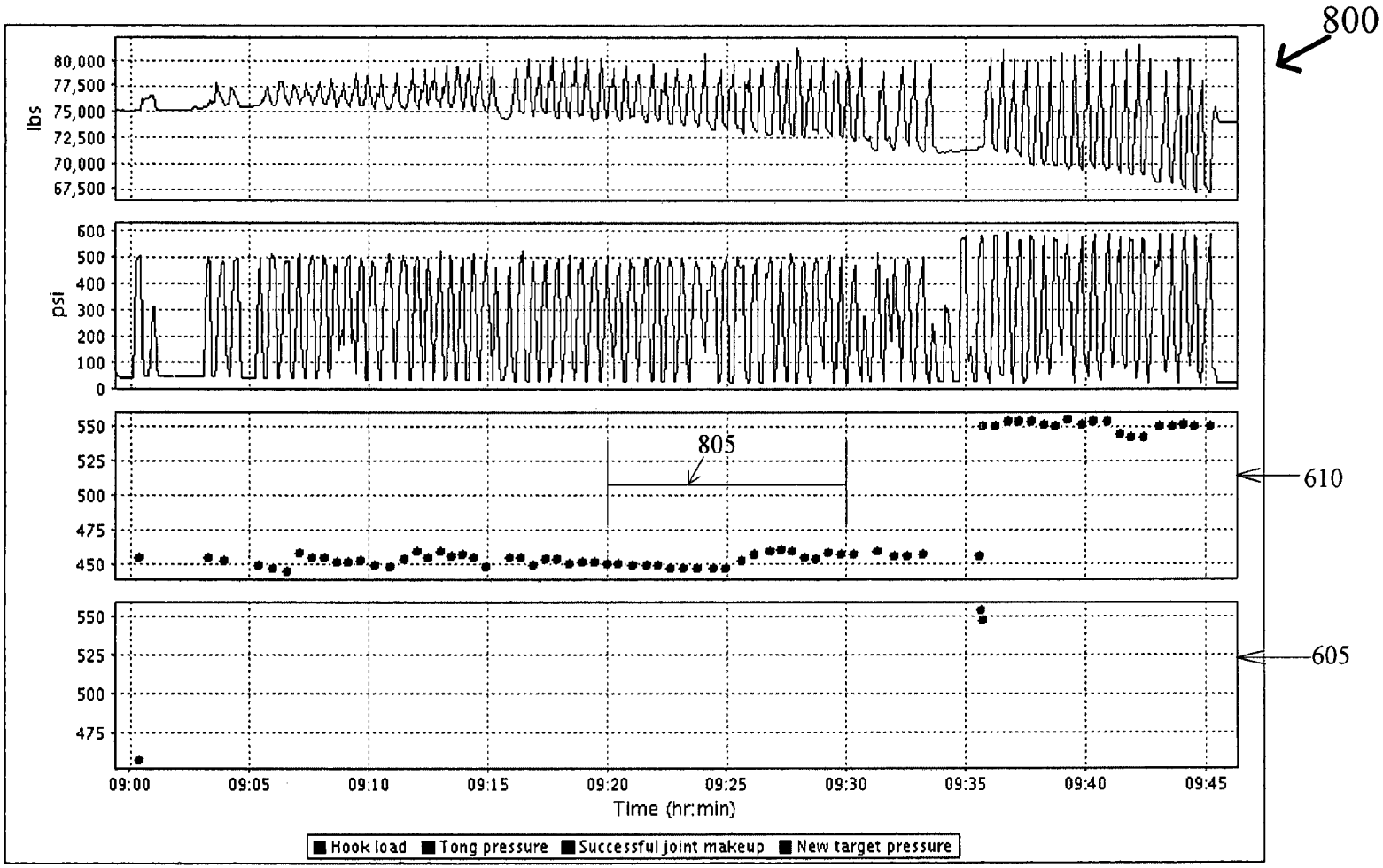
FIG. 8 is an exemplary chart displaying target hydraulic pressures and actual connection pressures in a display environment according to one exemplary embodiment of the present invention.

Those of ordinary skill in the art will recognize that sensors 24 and 28 attached to strain gages could be used in place of the hydraulic pressure sensors on the tongs 12 and still be within the scope of the present invention. When using strain gages, the process would be the same as that described in FIG. 2, except that the operator would determine the target strain on the tongs 12 during the make-up of the joint, record the target strain, determine if the strain at the tongs 12 is within a predetermined range of the target strain for subsequent rod or tubing joints, plot the maximum strain on the tongs 12, and evaluate the data to determine if the joints were made up with the proper amount of strain at the tongs 12. While FIGS. 7 and 8 provide charts of actual and target hydraulic pressures, it is well within the scope of this invention and the knowledge of those of ordinary skill in the art to modify the charts to accept the target and actual strain data for use by the operator and analysis by the supervisor.

Figure 3:
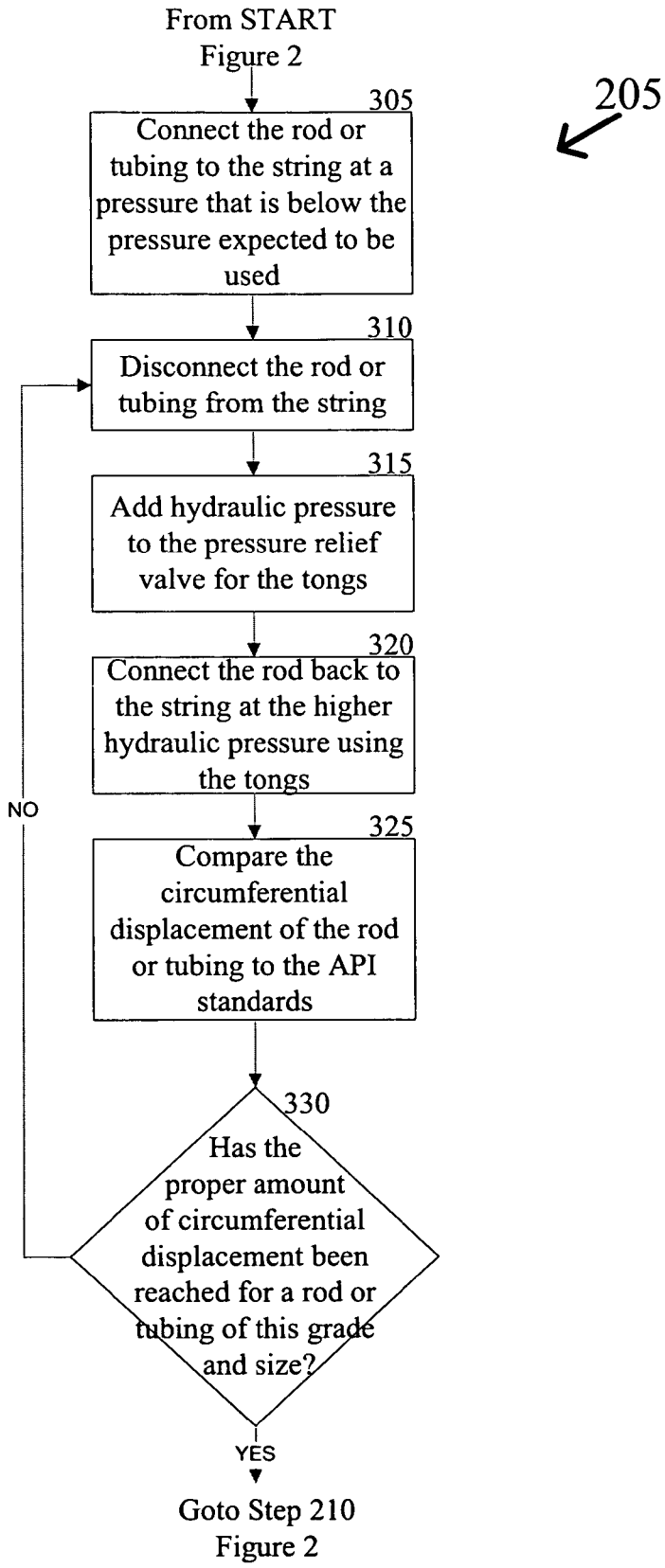
FIG. 3 is a flowchart of an exemplary process for determining the target hydraulic pressure according to one exemplary embodiment of the present invention.

FIG. 3 is a logical flowchart diagram illustrating an exemplary method for determining the target hydraulic pressure for tongs 12 to join rods 40 as completed by step 205 of FIG. 2. Referencing FIGS. 1, 1A, 1B, 2, and 3, the exemplary method 205 begins with the rod 40 being connected to a coupling 42 on a string 14 by the tongs 12 at a pressure that is below the anticipated target pressure in step 305. In one exemplary embodiment, the reason the rod 40 is initially connected to the string 14 at a pressure below the anticipated target pressure is because if the operator of the tongs tries to initially connect the rod 40 to the string 14 at what the operator believes the target pressure will be and his estimation is too high, the operator will have over-torqued the rod 40 by yielding the threads of the coupling 42 and rod 40 will have to be replaced.

In step 310, the rod 40 is disconnected from the string 14. Additional hydraulic pressure is added to the pressure relief valve 92 for the tongs 12 in step 315. In step 320, the tongs 12 are used to join the rod 40 to the string 14 at the higher hydraulic pressure. In step 325, the circumferential displacement of the rod 40 to the coupling 42 is compared to the standards set by the American Petroleum Institute ("API"). In step 320, an inquiry is conducted to determine if the proper amount of circumferential displacement has been achieved for a rod 40 of that grade and size. In one exemplary embodiment, the operator of the tongs 12 makes this determination. If the proper amount of circumferential displacement has not been achieved with the current level of hydraulic pressure being provided to the tongs 12, the "NO" branch is followed to step 310, where the rod 40 is disconnected from the coupling 42 again and additional hydraulic pressure is added to the pressure relief valve 92. Otherwise, the "YES" branch is followed to step 210 of FIG. 2.

Those of ordinary skill in the art will recognize that sensors 24 and 28 attached to strain gages could be used in place of the hydraulic pressure sensors on the tongs 12 and still be within the scope of the present invention described in FIG. 3. When using strain gages, the process would be the same as that described in FIG. 3, except that the operator would connect the rod or tubing by applying a strain at the tongs 12 at a strain lever below the strain expected to be used in the actual make-up of the joints, disconnect and reconnect at a higher strain level on the tongs 12, and determine if the proper circumferential displacement has been achieved.

Figure 4:
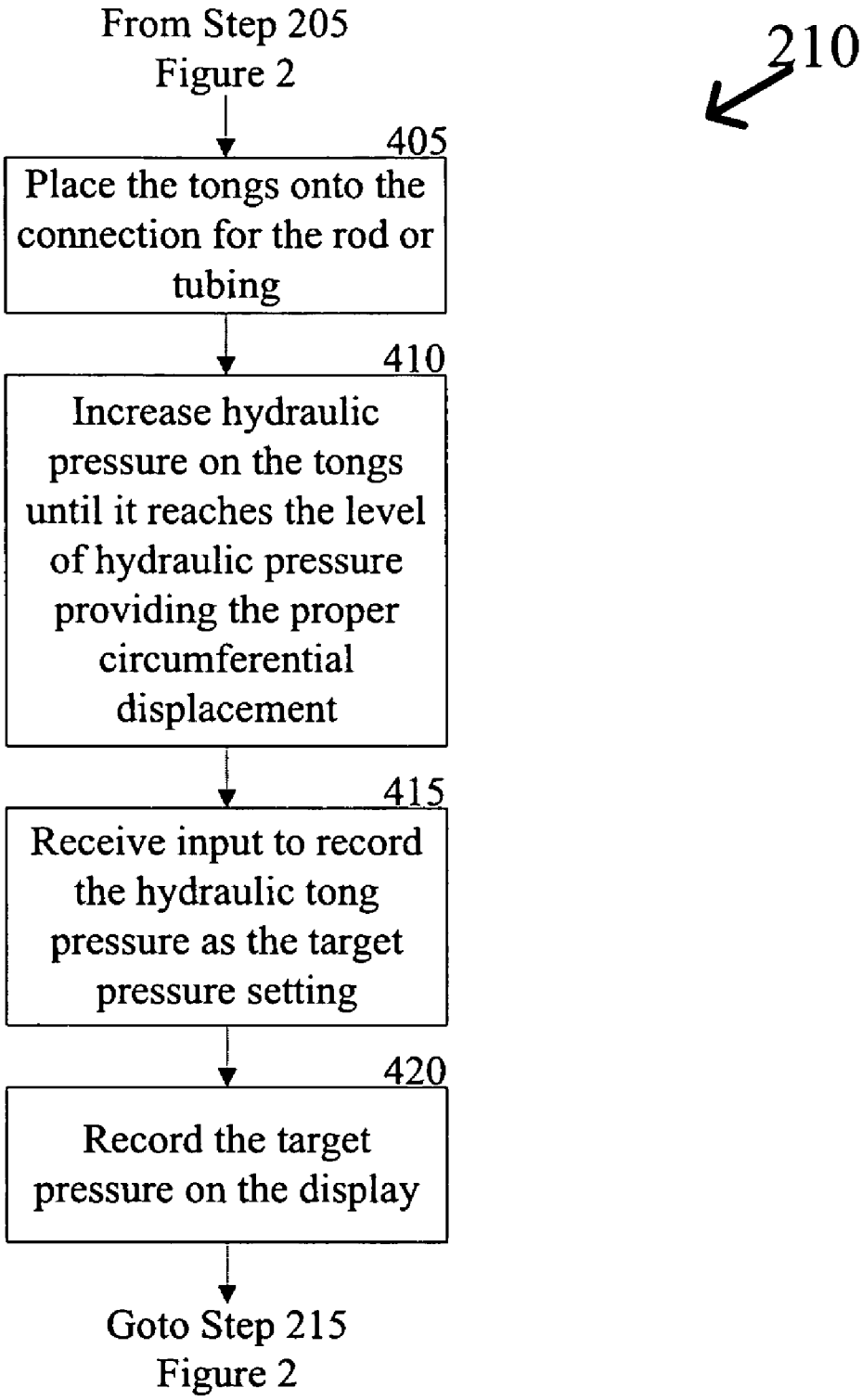
FIG. 4 is a flowchart of an exemplary process for setting and recording the target hydraulic pressure according to one exemplary embodiment of the present invention.

FIG. 4 a logical flowchart diagram illustrating an exemplary method for setting and recording the target hydraulic pressure as completed by step 210 of FIG. 2. Referencing FIGS. 1, 1A, 1B, 2, and 4, the exemplary method 210 begins with the tongs 12 being placed around the rod 40 and coupling 42 in step 405. In step 410, hydraulic pressure at the level that provided the proper circumferential displacement between the rod 40 and the coupling 42 is applied to drive the tongs 12.

A learn input 30 is received at the monitor 10 in step 415. In one exemplary embodiment, the learn input 30 records the current hydraulic pressure at the pressure sensor 24'. In one exemplary embodiment, the learn input 30 is a touch-pad key on a touch-pad at the monitor 10; however, those or ordinary skill in the art will recognize that other input devices including, but not limited to, a keypad, keyboard, pushbutton, and touchscreen on the display 23 are within the scope of this invention. In this exemplary embodiment, the input is generated by the tong operator. In step 420, the hydraulic pressure level reading from the input signal 34' at the pressure sensor 24' is recorded at the circuit 20 and displayed on the display screen 23. In one exemplary embodiment, the reading is stored in a memory storage device, such as a hard drive, read only memory, random access memory, or a database in the circuit 20. The process then continues to from step 420 to step 215 of FIG. 2.

Those of ordinary skill in the art will recognize that sensors 24 and 28 attached to strain gages could be used in place of the hydraulic pressure sensors on the tongs 12 and still be within the scope of the present invention described in FIG. 4. When using strain gages, the process would be the same as that described in FIG. 4, except that the operator would place the tongs 12 onto the tubing and increase strain on the tongs 12 until the proper circumferential displacement is achieved, receive an input of the current strain at the tongs 12 as the target strain setting, and record the target strain on the display.

Figure 5:
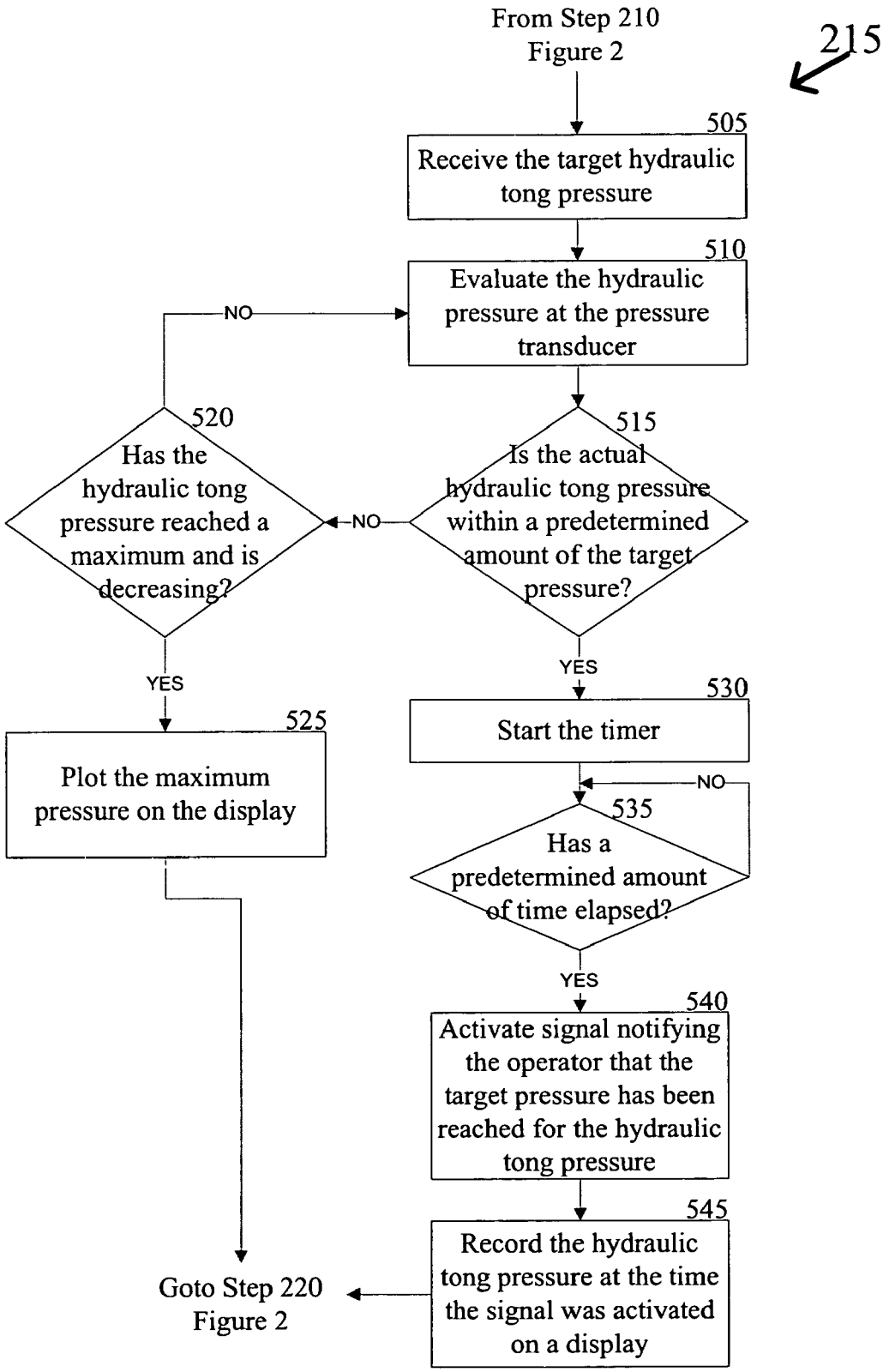
FIG. 5 is a flowchart of an exemplary process for determining if the target pressure has been reached for a rod or tubing connection according to one exemplary embodiment of the present invention.

FIG. 5 a logical flowchart diagram illustrating an exemplary method for determining is a target hydraulic pressure has been reached for a rod connection as completed by step 215 of FIG. 2. Referencing FIGS. 1, 1A, 1B, 2, and 5, the exemplary method 215 begins with the monitor 10 retrieving the target hydraulic pressure stored in circuit 20 in step 505. In one exemplary embodiment, the target hydraulic pressure is stored in a memory storage device, such as a hard drive, read only memory, random access memory, or a database in the circuit 20. In step 510, the circuit 20 evaluates the input signal 34' from the sensor 24' to determine the current hydraulic pressure. In one exemplary embodiment, the sensor 24' is a hydraulic pressure transducer that provides constant sensor data by way of the input signal 34' to the circuit 20 on the hydraulic pressure being provided to the tongs 12.

In step 515, an inquiry is conducted to determine if the input signal 34' of the hydraulic tong pressure at the sensor 24' is within a predetermined amount of the recorded target pressure. In one exemplary embodiment, the circuit 20 conducts the inquiry and determines if the current hydraulic tong pressure is within five percent above or below the target hydraulic pressure, however, other percentages above or below the target pressure may be programmed into the circuit 20. If the current hydraulic pressure at the sensor 24' is not within the predetermined amount, the "NO" branch is followed to step 520.

In step 520, an inquiry is conducted to determine if the current hydraulic pressure at the sensor 24' has reached a maximum and is decreasing. In one exemplary embodiment, the circuit 20 is continuously monitoring the input signal 34' from the sensor 24' and can determine if the pressure level outputs from the sensor 24' are trending up or down. If the pressure has not reached a maximum, the "NO" branch is followed to step 510, where the input signal 34' from the sensor 24' for the current hydraulic pressure is evaluated again. On the other hand, if the current hydraulic pressure has reached a maximum, the "YES" branch is followed to step 520, where the level of hydraulic pressure at the sensor 24' is recorded from the input signal 34' at the circuit 20 and displayed on the display screen 23. The process then continues from step 525 to step 220 of FIG. 2.

Returning to step 515, if the current hydraulic pressure at the sensor 24' is within the predetermined range of the target pressure, the "YES" branch is followed to step 530, where the timer 25 is started. Those of ordinary skill in the art will recognize that several types of timers can be incorporated into the design of the system and used to accomplish the timing step of this invention. In step 535, an inquiry is conducted to determine if a predetermined amount of time has elapsed since the timer 25 was activated. In one exemplary embodiment, the predetermined amount of time is two seconds; however, longer and shorter amounts of time are well within the scope of this invention. If the predetermined amount of time has not passed, the "NO" branch is followed back to step 535 to evaluate the timer 25 once again. Otherwise, the "YES" branch is followed to step 540.

In step 540, the circuit 20 activates an output signal 80 notifying the operator that the target pressure has been reached for the current connection of the rod 40 to the coupling 42. In one exemplary embodiment, the signal includes the activation of an audible alarm 90, or horn, that can be heard by the tong operator and others in the area. In another exemplary and/or complementary embodiment, a visual alarm can be activated by the circuit 20 when the time at or near the target pressure has elapsed. In this embodiment, the visual signal can include lights 86 and/or 88; however, messages on the display screen 23, sirens, strobe lights and other methods of visually attracting an operator's attention are well within the scope of this invention. In step 545, the hydraulic tong pressure at the sensor 24' at the time the timer 25 elapsed is recorded from the input signal 34' at the circuit 20 and displayed on the display screen 23. The process then continues from step 545 to step 220 of FIG. 2.

Those of ordinary skill in the art will recognize that sensors 24 and 28 attached to strain gages could be used in place of the hydraulic pressure sensors on the tongs 12 and still be within the scope of the present invention described in FIG. 5. When using strain gages, the process would be the same as that described in FIG. 5, except that the target strain would be received, the current strain at the tongs 12 is evaluated, if the actual strain is within the predetermined amount of the target strain the timer is started and upon elapsing a signal is generated and the current strain at the time of the signal is recorded, if the strain does not achieve the level of the target strain the maximum strain is recorded for the tongs 12.

Figure 6:
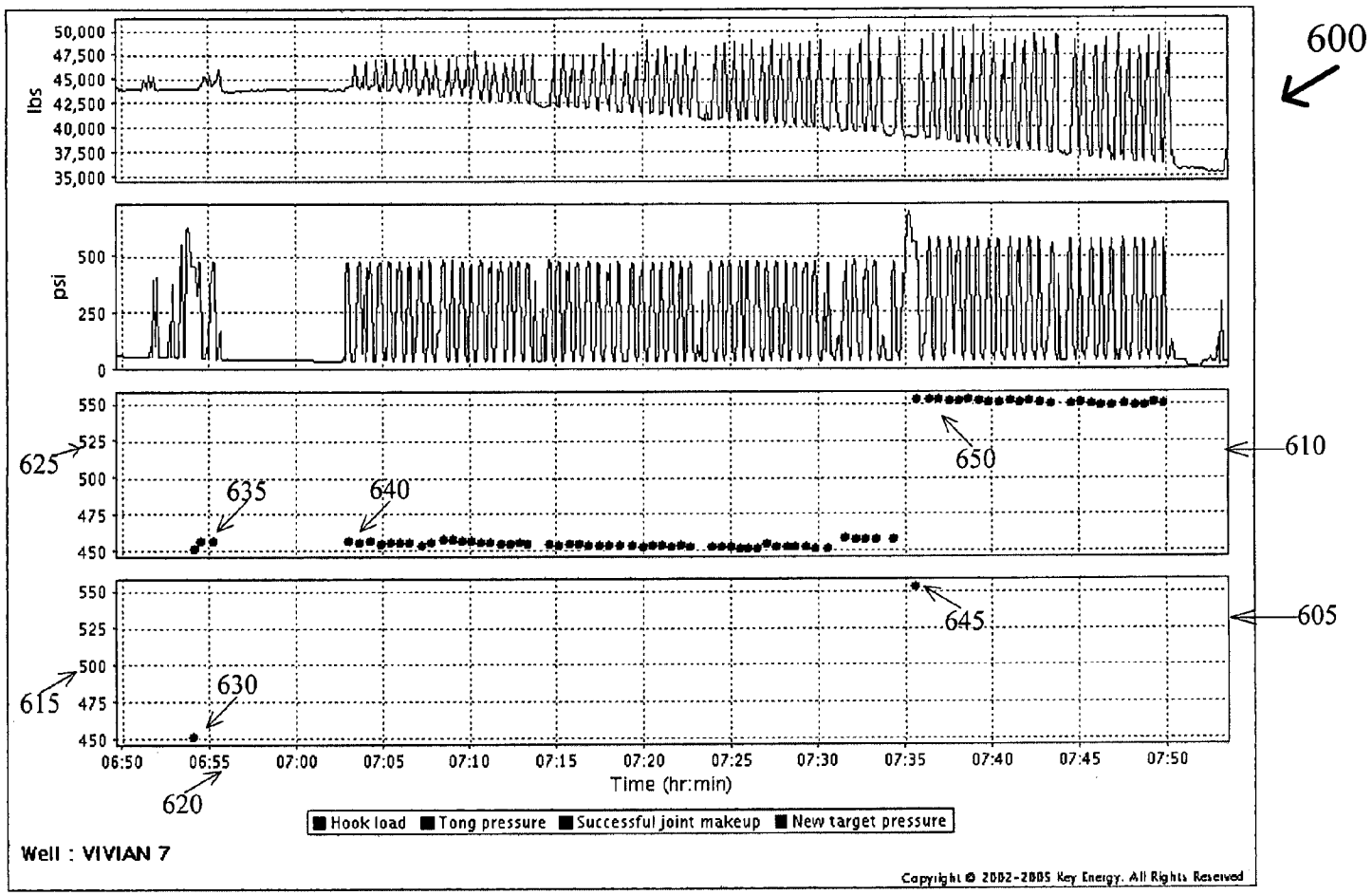
FIG. 6 is an exemplary chart displaying target hydraulic pressures and actual connection pressures in a display environment according to one exemplary embodiment of the present invention.

FIGS. 6 and 7 are a group of charts illustrating an exemplary display of the target hydraulic pressures and actual hydraulic pressures attained during the connection of elongated members 14 according to one exemplary embodiment of the present invention. Referencing FIGS. 1, 1A, 1B, and 6, the exemplary charts 600 can be shown on a single page of the display 23 or on individual pages that can be selected by an operator. The set target hydraulic pressure chart 605 has a y-axis 615 representing hydraulic pressure in pounds per square inch and an x-axis 620 representing time. In one exemplary embodiment, the x-axis 620 is represented in hours and minutes; however, those of ordinary skill in the art will recognize that other time intervals, such as minutes, seconds, or other partitions of an hour or day could be used. The set target hydraulic pressure chart 605 provides a graphical representation 630, 645 of the hydraulic pressure at the sensor 24' when the learn input 30 is selected by an operator.

An actual connection hydraulic pressure chart 610 has a y-axis 625 representing hydraulic pressure in pounds per square inch ("psi") and an x-axis 620 representing time. The actual connection pressure chart 610 provides a graphical representation 635, 640, 650 of the hydraulic pressure at the sensor 24' when the output signal 80 is generated in step 540 of FIG. 5 or when the pressure has reached a maximum, as described in step 520 of FIG. 5. As discussed previously in FIG. 5, in one exemplary embodiment, the output signal 80 is generated in step 540 if the hydraulic pressure at the sensor 24' is within five percent of the set target pressure. In one exemplary embodiment, the graphical representations for the connection pressures plotted on the chart 610 can be different for those that are inserted at the time the output signal 80 is generated versus those that are added because a maximum has been reached. For example, for color displays, green "dots" could be placed on the chart 610 when the pressure levels are recorded and displayed at the time the output signal 80 is generated, while red dots could be placed on the chart 610 when the pressure levels are recorded and displayed based on a maximum hydraulic pressure below the target pressure setting and its tolerance, have been reached. In another example, square dots could be inserted when they are generated at the time the signal is generated, while circular dots could be placed on the chart 610 when the are generated after a maximum hydraulic pressure below the target pressure setting and its tolerance, have been reached. Those of ordinary skill in the are will recognize that other methods of distinguishing data on a chart may be used and are well within the scope of this invention.

As shown in chart 605, the initial target pressure 630 for the connection process is 450 psi. Looking above to chart 610, the first two sets of actual connection pressures 635, 640 confirm that the rods 40 have been connected at the desired target pressure of 450 psi within the five percent tolerance of 22.5 psi above or below the target. Assuming that the operator properly set the target pressure as described in FIG. 3, a review of the data provided on charts 605, 610 for the initial target pressure 630 would lead to a conclusion that the rods 40 have been properly connected to the couplings 16 of the string 14.

Charts 600 of FIG. 6 also include a taper change to a rod 40 having a different diameter than the one used for the initial target pressure 630. As shown in chart 605, a second target pressure 645 was input into the monitor 10 and displayed on the display screen 23. Upon completion of resetting the target pressure to the second target pressure 645, the operator attached subsequent rods 40 to the string of members 14. The connection hydraulic pressures were plotted and displayed on the display screen 23 at the third set of connection hydraulic pressures 650 as shown in chart 610. A review of the third set of connection hydraulic pressures 650 as compared to the second set target pressure 645 leads to the conclusion that the rods 40 connected to the string 14 at the third set of connection hydraulic pressures 650 have been properly connected.

Now referring to FIG. 7, chart 605 includes three target pressure settings 705, 715, 720. As can be seen in chart 605, the operator set the desired target pressure 705 at 665 psi. Subsequently, the operator began to connect rods 40 as shown in chart 610. The actual connection pressure readings in chart 610 show a steady decline in connection pressure 710. In one exemplary embodiment, this decrease in hydraulic pressure is caused when the hydraulic system heats up and causes the hydraulic fluid to lose viscosity and the hydraulic pump to become less efficient, thereby causing the final pressure of each connection to be less than the prior connection pressure. When the actual connection pressure falls below the predetermined threshold of the target pressure setting 725 the output signal 80 notifying the operator that he has made a proper connection is not generated.

At this point, the correct procedure for the operator to follow would have been to add additional pressure to the pressure relief valve 92 to bring the pressure back up within the 665 psi target range. Instead, as shown in chart 605 of FIG. 7, the operator once again pressed the learn input 30 for the current hydraulic pressure at the sensor 24' and reset the target pressure to the second target pressure 715. The operator went through the same process again and when the output signal 80 was no longer received 730 the operator once again pressed the learn input 30 for the current hydraulic pressure at the sensor 24' and reset the target pressure to the third target pressure 720.

Figure 7A:
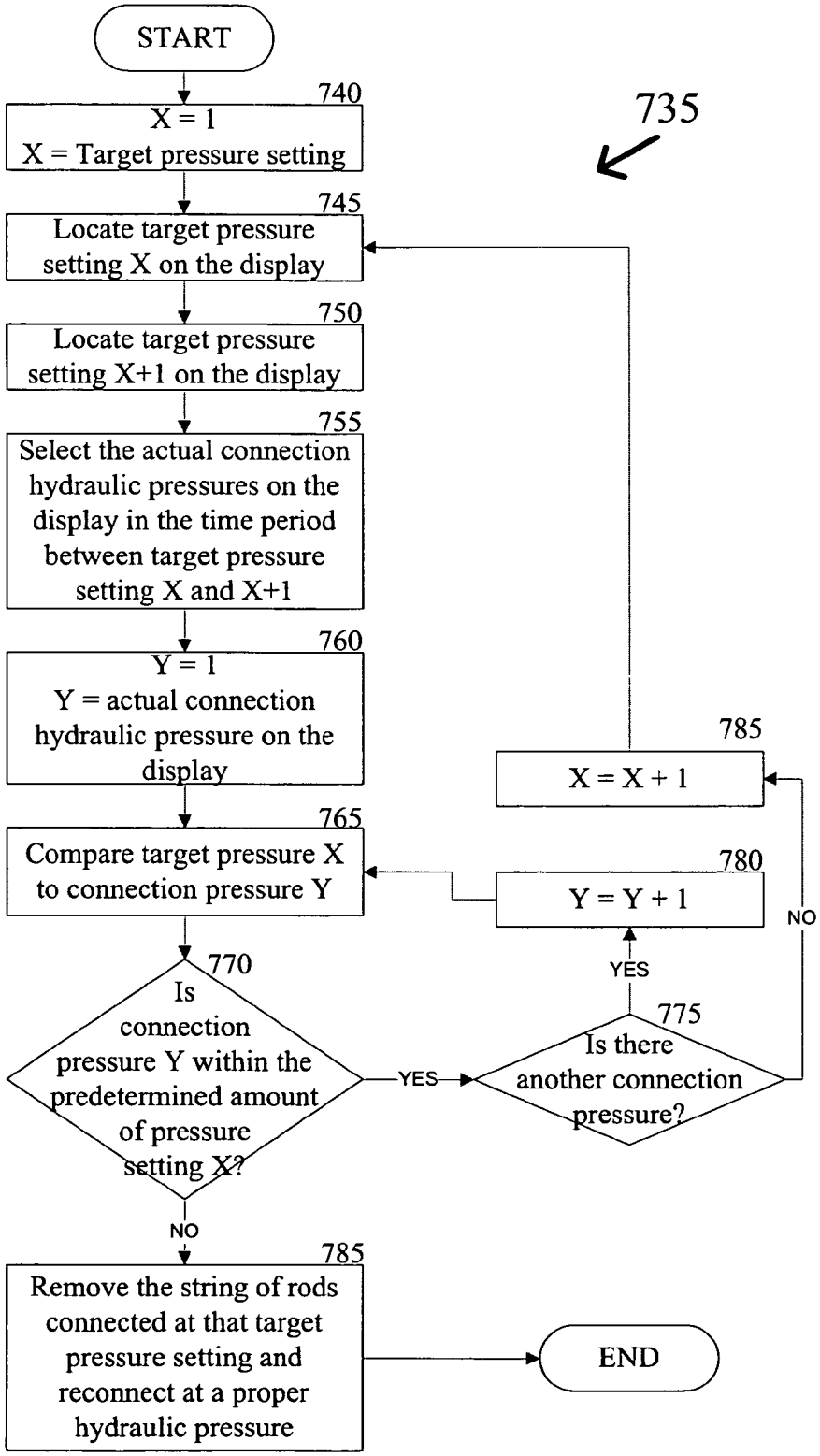
FIG. 7A is a flowchart of an exemplary process for evaluating whether a string of tubing was connected with a predetermined range of the target pressure setting according to one exemplary embodiment of the present invention.

FIG. 7A a logical flowchart diagram illustrating an exemplary method 735 for evaluating whether a string of members 14 were connected at the target pressure setting as shown in FIGS. 6 and 7. Referencing FIGS. 1, 1A, 1B, 6, 7, and 7A, the exemplary method 735 begins at the START step and continues to step 740, where a counter variable X is being set equal to one. In one exemplary embodiment, the counter variable X represents a target pressure setting data point on chart 605 of FIGS. 6 and 7. In step 745, the first target pressure setting is located on the display 23. In one exemplary embodiment, target pressure setting 705 of FIG. 7 represents the first target pressure setting. The next target pressure setting is located on the display 23 in step 750. In one exemplary embodiment, target pressure setting 715 is the next target pressure setting on chart 605.

In step 755, the actual connection hydraulic pressures in chart 610 on the display 23 that are between the time periods of target pressure setting 705 and target pressure setting 715 are selected. Counter variable Y is set equal to one in step 760. In one exemplary embodiment, counter variable Y represents the actual connection hydraulic pressure readings on the chart 610 on the display 23. In step 765, the first target pressure 705 in chart 605 is compared to the first actual connection hydraulic pressure value in chart 610. In step 770, an inquiry is conducted to determine if the first actual connection hydraulic pressure is within the predetermined range of the first target pressure setting. As discussed above, in one exemplary embodiment, the predetermined range is plus or minus five percent of the target pressure setting. If the actual connection hydraulic pressure is within the range, the "YES" branch is followed to step 775.

In step 775, an inquiry is conducted to determine if there is another actual connection hydraulic pressure between the two target pressure settings in chart 610. If so, then the "YES" branch is followed to step 780, where the counter variable Y is incremented by one. The process then returns to step 765. If there are no additional connection hydraulic pressure values, then the "NO" branch is followed to step 785, where the counter variable X is incremented by one. The process then returns to step 745. Returning to step 770, if the connection hydraulic pressure value in chart 610 is not within the predetermined range of the target pressure setting, the "NO" branch is followed to step 785, where the string of rods 40 is disconnected and removed from the well and reconnected following the proper procedure as described in FIGS. 2-5. In one exemplary embodiment, connection pressure values 725 and 730 of FIG. 7 represent values on chart 610 that are below the allowable range of the target pressure setting. The process continues from step 785 to the END step.

Those of ordinary skill in the art will recognize that sensors 24 and 28 attached to strain gages could be used in place of the hydraulic pressure sensors on the tongs 12 and still be within the scope of the present invention described in FIG. 7A. When using strain gages, the process would be the same as that described in FIG. 7A, except that the counter variable X represents target strain and Y represents the actual strain on the display, the target strains are located and the actual strain is compared to the target strain that occurs before the actual strain, if the actual strain was not within the predetermined amount of the target strain the rods or tubing are removed from the well and reconnected with the proper strain on the tongs 12.

Figure 8A:
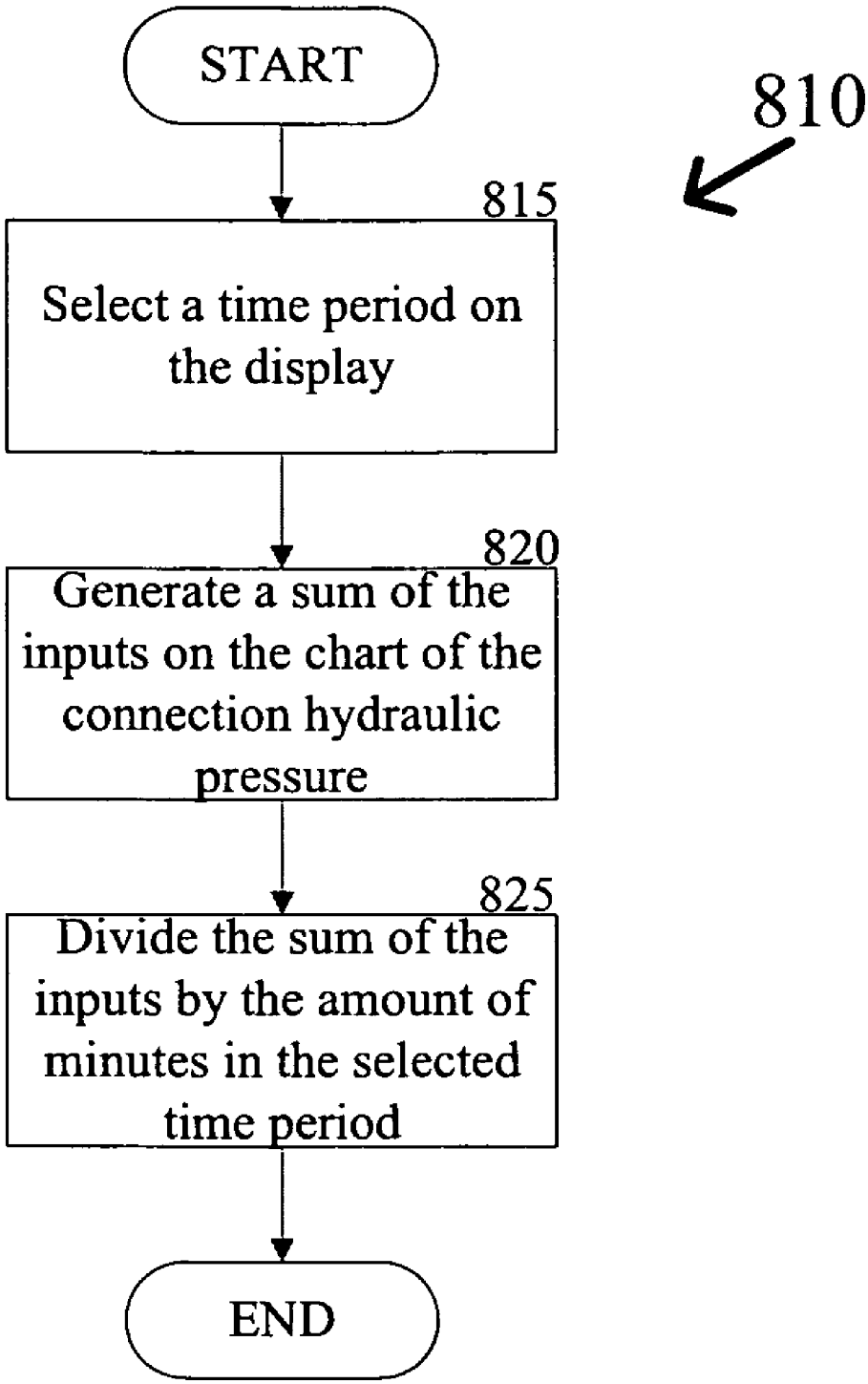
FIG. 8A is a flowchart of an exemplary process for determining the speed of the tong connection operation according to one exemplary embodiment of the present invention.

FIGS. 8 and 8A represent an exemplary chart 800 and method 810 for determining the speed of the tong connection operation according to one exemplary embodiment of the present invention. Now referring to FIGS. 1, 1A, 1B, 8, and 8A, the exemplary method 810 begins at the START step and continues to step 815, where a time period is selected on chart 610 of the display 23. In one exemplary embodiment, FIG. 8 shows a selection of a ten minute time period 805 between 9:20 and 9:30. In step 820, the sum of the inputs on the chart 610 within that time period 805 is determined. In one exemplary embodiment, the number of inputs is determined by the circuit 20, however other methods known to those of ordinary skill in the art, including having the operator count the number of inputs within the selected time range, are within the scope of the present invention. In step 825, the sum of the inputs on chart 610 within the time period 805 is divided by the number of minutes selected in the time period 805. In the exemplary embodiment shown in FIG. 8, the number of inputs, nineteen, is divided by the number of minutes within the time period 805, ten, to arrive at a connection speed of 1.9 stands per minute. The process continues from step 825 to the END step.

Those of ordinary skill in the art will recognize that sensors 24 and 28 attached to strain gages could be used in place of the hydraulic pressure sensors on the tongs 12 and still be within the scope of the present invention described in FIG. 8A. When using strain gages, the process would be the same as that described in FIG. 8A, except that the sum of the inputs generated from the chart would be the sum of the actual strain inputs, which is then divided by the time period.

Although the invention is described with reference to a preferred embodiment, it should be appreciated by those skilled in the art that various modifications are well within the scope of the invention. Therefore, the scope of the invention is to be determined by reference to the claims that follow. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by any claims that follow.

I claim:

1. A method for monitoring the tightening of a plurality of joints by a set of tongs comprising the steps of:

determining a target pressure applied by the set of tongs to a first joint;

displaying the target pressure on a display device;

receiving an actual pressure applied by the set of tongs to each of a plurality of joints;

determining if the target pressure is applied by the set of tongs to each of the plurality of joints;

recording the actual pressure applied by the set of tongs to each of the plurality of joints on the display device; and evaluating the actual pressure and the target pressure displayed on the display device to determine if the actual pressure applied to each joint is within a predetermined range of the target pressure.

2. The method of claim 1, wherein the step of determining the target pressure applied to the set of tongs comprises the steps of:

a. connecting the first joint by applying a first pressure with the set of tongs to the first joint comprising a first elongated member and a coupling;

b. determining if a circumferential displacement between the first elongated member and the coupling meets a predetermined criteria;

c. disconnecting the first joint if the circumferential displacement does not meet the predetermined criteria;

d. adding an amount of additional pressure to the first pressure applied by the set of tongs;

e. determining if the circumferential displacement between the first elongated member and the coupling meets the predetermined criteria;

f. repeating steps (c)-(e) if the circumferential displacement does not meet the predetermined criteria;

g. receiving an input for the target pressure if the circumferential displacement between the first elongated member and the coupling meets the predetermined criteria; and h. recording a target pressure in a memory storage device, wherein the target pressure setting comprises a pressure applied by the set of tongs that achieves the predetermined criteria of circumferential displacement between the first elongated member and the coupling.

3. The method of claim 1, wherein the first range of the target pressure comprises ninety-five percent to one hundred and five percent of the target pressure.

4. The method of claim 1, wherein the actual pressure and the target pressure comprise hydraulic pressures.

5. The method of claim 1, wherein each joint comprises a coupling and one of the group consisting of: a rod, a stand of tubing and casing.

6. The method of claim 1, further comprising the step of recording the target pressure in a memory storage device.

7. The method of claim 1, further comprising the step of recording the actual pressure applied by the set of tongs in a memory storage device.

8. The method of claim 1, wherein evaluating the actual pressure and target pressure on the display to determine if the actual pressure is within a predetermined range of the target pressure comprises the steps of:

a. receiving a first target pressure on the display at a first time;

b. selecting at least one actual pressure recorded on the display after the first time;

c. comparing the actual pressure on the display to the first target pressure to determine if the actual pressure is within the predetermined range of the first target pressure; and d. disconnecting at least one of the plurality of joints for the first target pressure if the actual pressure is not within the predetermined range of the first target pressure.

9. The method of claim 8, wherein the display comprises a computer monitor.

10. The method of claim 8, further comprising the step of repeating steps (b)-(d) for each of the plurality actual pressures recorded on the display after the first time.

11. The method of claim 1, wherein the step of determining if the target pressure is applied to each of the plurality of joints comprises the steps of:

applying the set of tongs about one of the plurality of joints;

receiving a current pressure input at the set of tongs, the current pressure input representing the amount of pressure being applied by the set of tongs to the joint;

determining if the current pressure input is within the predetermined range of the target pressure;

activating a timer if the current pressure input is within the predetermined range of the target pressure;

determining if a predetermined amount of time has elapsed since the timer was activated;

activating a signal representing that the predetermined amount of time has elapsed; and displaying the actual pressure applied by the set of tongs to the joint at the time the signal was activated on the display.

12. The method of claim 11, wherein the predetermined amount of time is approximately two seconds.

13. The method of claim 11, further comprising the steps of:

determining a maximum pressure applied by a set of tongs to the joint if the current pressure input applied by the tongs to the joint never falls within the first range of the target pressure; and displaying the maximum pressure applied by the set of tongs to the joint on the display.

14. The method of claim 11, wherein the signal is an audible signal.

15. The method of claim 11, wherein the signal is a visual signal.

16. A method for monitoring the tightening of a plurality of joints by a set of tongs comprising the steps of:

a. receiving a target hydraulic pressure at a display device;

b. applying the set of tongs about one of the plurality of joints;

c. receiving a current hydraulic pressure input at the set of tongs, the current hydraulic pressure input representing the amount of hydraulic pressure being applied by the set of tongs to the joint;

d. determining if the current hydraulic pressure input is within the predetermined range of the target hydraulic pressure;

e. activating a signal if the current hydraulic pressure input is within the predetermined range of the target hydraulic pressure;

f. displaying an actual hydraulic pressure on the display device, wherein the actual hydraulic pressure comprises the current hydraulic pressure applied by the set of tongs to the joint at the time the signal was activated;

g. repeating steps (b)-(f) for each of the plurality of joints; and h. evaluating the actual hydraulic pressure and the target hydraulic pressure displayed on the display device to determine if the actual hydraulic pressure applied to each joint is within a predetermined range of the target hydraulic pressure.

17. The method of claim 16, further comprising the steps of:

activating a timer if the current pressure input is within the predetermined range of the target pressure;

determining if a predetermined amount of time has elapsed since the timer was activated; and activating the signal if the predetermined amount of time has elapsed.

18. The method of claim 17, wherein the predetermined amount of time is approximately two seconds.

19. The method of claim 16, wherein evaluating the actual hydraulic pressure and target hydraulic pressure on the display to determine if the actual hydraulic pressure is within a predetermined range of the target hydraulic pressure comprises the steps of:

a. receiving a first target hydraulic pressure on the display at a first time;

b. receiving a second target hydraulic pressure on the display at a second time;

c. selecting at least one actual hydraulic pressure recorded on the display between the first time and the second time;

d. comparing the actual hydraulic pressure on the display to the first target hydraulic pressure to determine if the actual hydraulic pressure is within the predetermined range of the first target hydraulic pressure;

e. disconnecting at least one of the plurality of joints connected between the first time and the second time for the first target hydraulic pressure if the actual hydraulic pressure is not within the predetermined range of the first target hydraulic pressure; and f. repeating steps (c)-(e) for each of the plurality actual hydraulic pressures recorded on the display between the first time and the second time.

20. The method of claim 19, wherein the display comprises a computer monitor.

21. The method of claim 19, wherein the display comprises a touchscreen monitor.

22. A method of evaluating a connection speed for a plurality of joints by a set of tongs comprising the steps of:

receiving a plurality of pressure inputs on a display, each input comprising the maximum pressure applied by the set of tongs to each of the plurality of joints;

selecting a time period on the display, the time period comprising at least one of the plurality of pressure inputs;

determining the total number of pressure inputs received on the display during the time period; and calculating the connection speed by dividing the total number of pressure inputs by the amount of time in the time period.

23. The method of claim 22, wherein the display comprises a chart on a visual display device.

24. The method of claim 22, wherein the display comprises a plotter.

25. A method for monitoring the tightening of a plurality of joints by a set of tongs comprising the steps of:

determining a target strain at the set of tongs to a first joint;

displaying the target strain on a display device;

receiving an actual strain generated at the set of tongs during the coupling of each of a plurality of joints;

determining if the target strain is generated at the set of tongs during the coupling of each of the plurality of joints;

recording the actual strain generated at the set of tongs during the coupling of each of the plurality of joints on the display device; and evaluating the actual strain and the target strain displayed on the display device to determine if the actual strain is within a predetermined range of the target strain.

26. The method of claim 25, wherein the step of determining the target strain at the set of tongs comprises the steps of:

a. connecting the first joint by generating a first strain at the set of tongs while coupling the first joint comprising a first elongated member and a coupling;

b. determining if a circumferential displacement between the first elongated member and the coupling meets a predetermined criteria;

c. disconnecting the first joint if the circumferential displacement does not meet the predetermined criteria;

d. generating an amount of additional strain to the first strain at the set of tongs while coupling the first joint;

e. determining if the circumferential displacement between the first elongated member and the coupling meets the predetermined criteria;

f. repeating steps (c)-(e) if the circumferential displacement does not meet the predetermined criteria;

g. receiving an input for the target strain if the circumferential displacement between the first elongated member and the coupling meets the predetermined criteria; and h. recording a target strain in a memory storage device, wherein the target strain setting comprises a strain generated at the set of tongs that achieves the predetermined criteria of circumferential displacement between the first elongated member and the coupling.

27. The method of claim 25, wherein the first range of the target strain comprises ninety-five percent to one hundred and five percent of the target strain.

28. The method of claim 25, wherein each joint comprises a coupling and one of the group consisting of: a rod, a stand of tubing and casing.

29. The method of claim 25, further comprising the step of recording the target strain and the actual strain in a memory storage device.

30. The method of claim 25, wherein evaluating the actual strain and target strain on the display to determine if the actual strain is within a predetermined range of the target strain comprises the steps of:

a. receiving a first target strain on the display at a first time;

b. selecting at least one actual strain recorded on the display after the first time;

c. comparing the actual strain on the display to the first target strain to determine if the actual strain is within the predetermined range of the first target strain; and d. disconnecting at least one of the plurality of joints for the first target strain if the actual strain is not within the predetermined range of the first target strain.

31. The method of claim 30, further comprising the step of repeating steps (b)-(d) for each of the plurality actual strains recorded on the display after the first time.

32. The method of claim 25, wherein the step of determining if the target strain is generated at the set of tongs during the coupling of each of the plurality of joints comprises the steps of:

applying the set of tongs about one of the plurality of joints;

receiving a current strain input from a strain gage, the current strain input representing the amount of strain being generated at the set of tongs;

determining if the current strain input is within the predetermined range of the target strain;

activating a timer if the current strain input is within the predetermined range of the target strain;

determining if a predetermined amount of time has elapsed since the timer was activated;

activating a signal representing that the predetermined amount of time has elapsed; and displaying the actual strain generated at the set of tongs while coupling the joint at the time the signal was activated on the display.

33. The method of claim 32, wherein the predetermined amount of time is approximately two seconds.

34. The method of claim 32, further comprising the steps of:

determining a maximum strain generated at a set of tongs while coupling the joint if the current strain input generated at the tongs never falls within the first range of the target strain; and displaying the maximum strain generated at the set of tongs to the joint on the display.

* * * * *